US009927205B2

(12) United States Patent
Davis

(10) Patent No.: US 9,927,205 B2
(45) Date of Patent: Mar. 27, 2018

(54) VORTEX RING-PRODUCING GUN WITH RECOILING NOZZLE

(71) Applicant: Jeffery M. Davis, Manassas, VA (US)

(72) Inventor: Jeffery M. Davis, Manassas, VA (US)

(73) Assignee: Jeffery M. Davis, Manassas, VA (US)

( * ) Notice: Subject to any disclaimer, the term of this patent is extended or adjusted under 35 U.S.C. 154(b) by 202 days.

(21) Appl. No.: 14/622,107

(22) Filed: Feb. 13, 2015

(65) Prior Publication Data

US 2015/0190820 A1 Jul. 9, 2015

Related U.S. Application Data

(60) Provisional application No. 61/944,733, filed on Feb. 26, 2014.

(51) Int. Cl.

| | |
|---|---|
| ***F41B 11/643*** | (2013.01) |
| ***F41B 9/00*** | (2006.01) |
| ***F41B 11/89*** | (2013.01) |
| ***A63H 33/28*** | (2006.01) |

(52) U.S. Cl.

CPC ..... *F41B 11/643* (2013.01); *A63H 33/28* (2013.01); *F41B 9/004* (2013.01); *F41B 9/0037* (2013.01); *F41B 9/0075* (2013.01); *F41B 11/89* (2013.01)

(58) Field of Classification Search

CPC ..... F41B 11/89; F41B 11/643; F41B 9/0037; F41B 9/004; F41B 9/0075; F41B 11/642; F41B 9/0031; F15D 1/009; B05B 1/06; B05B 3/18; B05B 3/00; B05B 11/3014; B05B 11/3059; B05B 11/306; B05B 11/3091; B05B 1/02; B05B 1/08; A63H 33/28; A63H 5/04

USPC ..... 239/459, 526, 530, 532, 461, 579, 602, 239/541, 589; 124/55, 66; 446/24, 153

See application file for complete search history.

(56) References Cited

U.S. PATENT DOCUMENTS

| | | | | |
|---|---|---|---|---|
| 3,940,060 | A * | 2/1976 | Viets | B64F 1/18 239/14.1 |
| 4,368,830 | A * | 1/1983 | Soughers | B05B 11/306 222/153.13 |
| 2004/0164186 | A1* | 8/2004 | Kladders | A61M 15/0065 239/543 |
| 2005/0017089 | A1* | 1/2005 | Rohrschneider | B05B 11/306 239/333 |

(Continued)

*Primary Examiner* — Christopher Kim
*Assistant Examiner* — Cody Lieuwen
(74) *Attorney, Agent, or Firm* — Hauptman Ham, LLP

(57) ABSTRACT

A vortex ring producing gun includes a body defining a first interior volume. The vortex ring producing gun includes a movable nozzle coupled with the body, comprising at least one nozzle opening, and defining a second interior volume. The vortex ring producing gun includes one or more conduits providing fluid communication between said first interior volume and said second interior volume. The vortex ring producing gun includes an energy storage element configured to bias the movable nozzle in a first direction. The vortex ring producing gun includes a latching key configured to hold the movable nozzle in a retained position against the bias from the energy storage element. The vortex ring producing gun includes a movable cocking/firing element configured to interact with the body, the energy storage element, the latching key, and the movable nozzle to selectively cock or fire the vortex ring-producing gun.

35 Claims, 11 Drawing Sheets

(56) References Cited

U.S. PATENT DOCUMENTS

2008/0264505 A1* 10/2008 Matsuo ..... B60H 1/34
137/808
2012/0052965 A1* 3/2012 Curry ..... A63H 33/28
472/128

* cited by examiner

VORTEX RING-PRODUCING GUN WITH RECOILING NOZZLE

BACKGROUND

Novelty devices exist, such as toy guns, which produce vortex rings of air or water. Accuracy, entertainment value, and pressure relief have been among the considerations that have defined some of the features of such novelty devices. One of the primary concerns regarding pressure relief relates to the prospect of a child firing the toy after placing the nozzle against his, or another child's ear. If the nozzle is essentially sealed against the ear, then considerable pressure will be exerted on the ear when the toy is fired.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Figure 1:
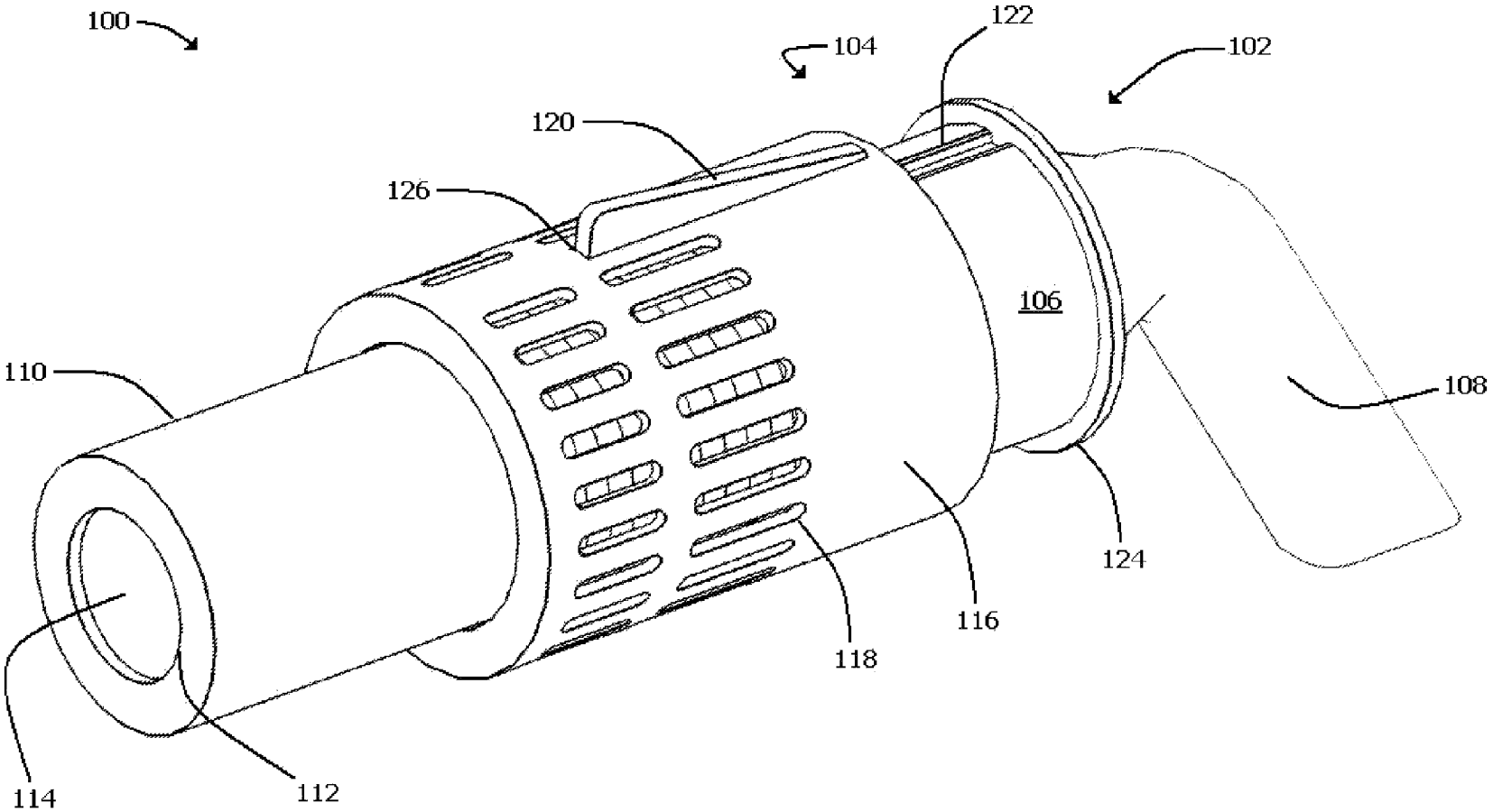
FIG. 1 is an isometric view of a vortex ring-producing gun according to some embodiments.

FIG. 1 is an isometric view of a vortex ring-producing gun 100 (also referred to herein as vortex ring gun, toy vortex gun, vortex gun, ring gun, toy gun, or gun) according to some embodiments. Operation of vortex ring gun 100 causes the production and propulsion of a vortex ring of fluid from a nozzle of the gun. In at least some embodiments, the vortex ring produced includes a second fluid, e.g., air, another gas, a colored fluid, a colorant material, or another suitable second fluid within the vortex ring. Vortex ring gun 100 includes a recoiling nozzle 110 (also referred to herein as movable nozzle, or nozzle). Recoiling nozzle 110 is capable of limiting a pressure experienced by an external target that is positioned immediately adjacent an output of the nozzle when the gun is fired.

Vortex ring gun 100 includes a body 102, which, in at least some embodiments, is made of a molded plastic material. In at least some embodiments, body 102 comprises a right half 104 and a left half 106, joined along a centerline of the gun. In at least some embodiments, right half 104 and left half 106 are substantially mirror images of each other. In at least some embodiments, body 102 is made of a single piece of material, e.g., a single molded piece. In at least some embodiments, body 102 is made of a shaped plastic material. In at least some embodiments, body 102 is made of a metal, wood, fiber, or other suitable material.

Figure 2:
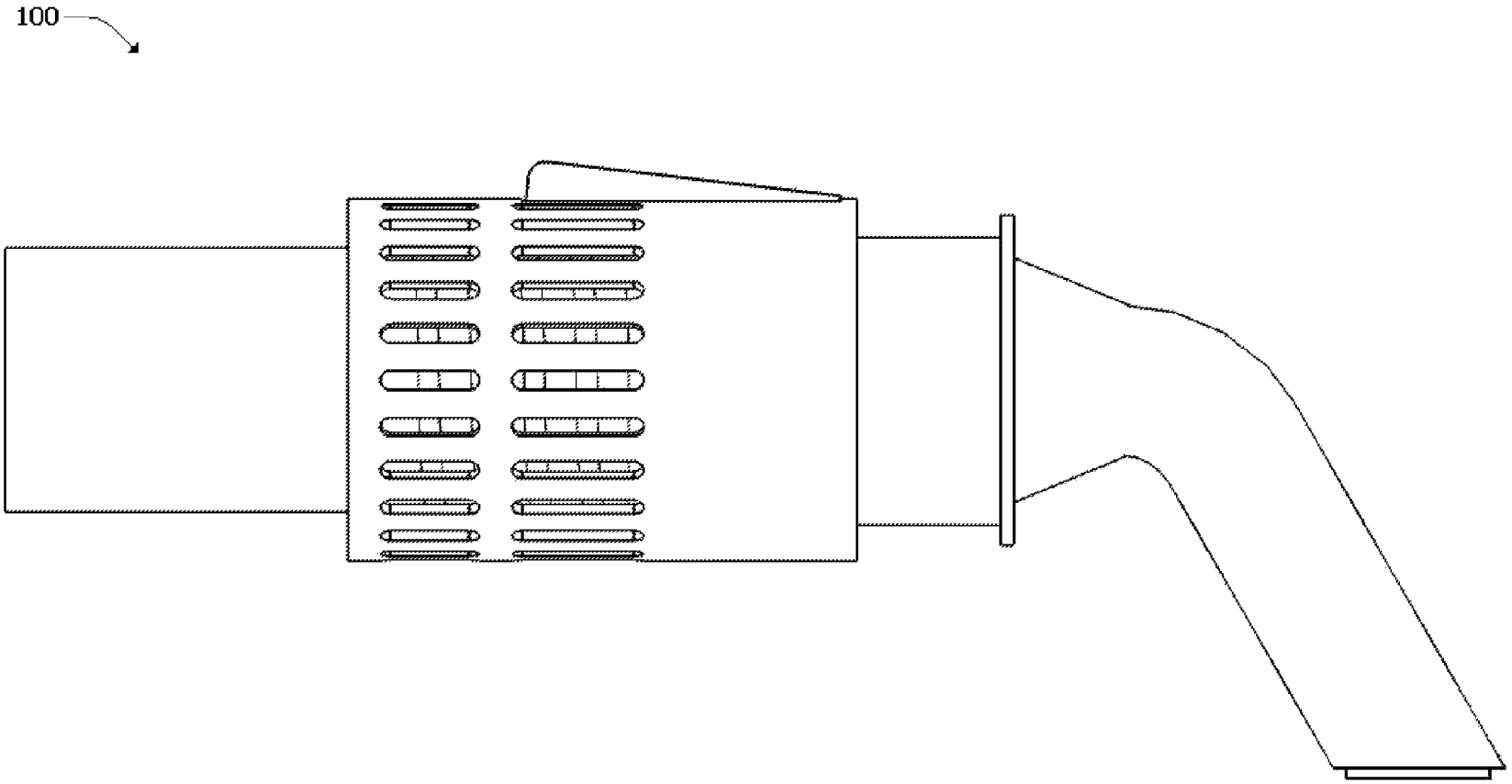
FIG. 2 is a side plan view of the vortex ring-producing gun of FIG. 1.

FIG. 2 is a side view of vortex gun 100.

Figure 3:
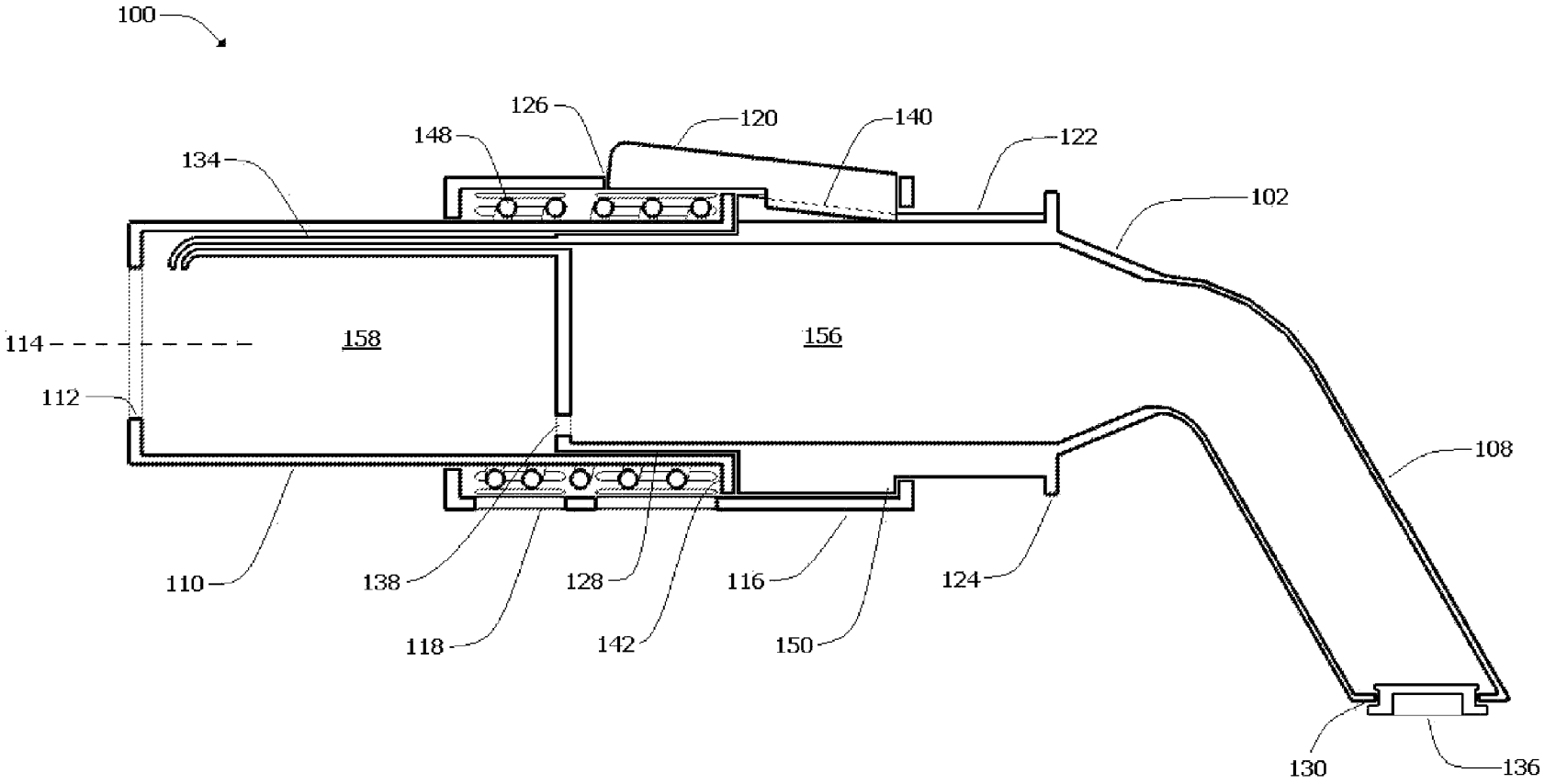
FIG. 3 is a side section view of the vortex ring-producing gun of FIG. 1 in a relaxed condition.

FIG. 3 is a side section view of vortex gun 100 in a relaxed condition. Body 102 is generally hollow and defines a first chamber 156. Body 102 includes an opening 130 near a lowest extent of the body. Opening 130 provides fluid communication from first chamber 156 to an exterior of gun 100. In at least some embodiments, gun 100 is able to receive a plug or cover 136 that is able to be inserted into or adjacent opening 130 to prevent fluid communication from first chamber 156 to the exterior of gun 100.

Body 102 also includes a grip 108. In at least some embodiments, grip 108 extends upward from opening 130. In at least some embodiments the bottom of grip 108 is the lowest extent of body 102 and first chamber 156.

Body 102 also includes a protrusion 128 on which nozzle 110 slides. The assembly of nozzle 110 together with body 102 defines a second chamber 158. Second chamber 158 is in fluid communication with an exterior of gun 100 through a nozzle opening 112.

Vortex ring gun 100 also includes a fluid conduit 134 for providing fluid communication between first chamber 156 and second chamber 158. In at least some embodiments, fluid conduit 134 has a tubular structure. In at least some other embodiments, fluid conduit 134 is a hole in a surface of body 102. In at least some embodiments, fluid conduit 134 connects an interior of body 102 to an exterior of the body. In at least some embodiments, one end of fluid conduit 134 is positioned at an upper end of body 102. In at least some embodiments, one end of fluid conduit 134 is positioned at a lower end of body 102.

Vortex ring gun 100 also includes a fluid conduit 138 for providing fluid communication between first chamber 156 and second chamber 158. In at least some embodiments, fluid conduit 138 is omitted. In at least some embodiments, fluid conduit 138 is a hole in a surface of body 102. In at least some embodiments, fluid conduit 138 connects an interior of body 102 to an exterior of the body. In at least some other embodiments, fluid conduit 138 has a tubular structure. In at least some embodiments, one end of fluid conduit 138 is positioned near a lower portion of body 102. In at least some embodiments, one end of fluid conduit 138 is positioned near the upper portion of body 102.

Body 102 also includes at least one keyway 122 in at least one surface of body 102. Keyway 122 is a rectangular trough that includes at least one ramped surface 140 whose distance from a center axis of body 102 changes along a length of the axis of body 102. In at least some embodiments, keyway 122 is a shape other than rectangular.

Body 102 also includes two ridges extending from an exterior surface of body 102. A first ridge 124 is positioned on body 102 such that the first ridge interferes with a cocking/firing sleeve 116, thereby defining a farthest rearward extent of sliding travel of cocking/firing sleeve 116 along the axis of body 102. Cocking/firing sleeve 116 is also referred to as a cocking/firing element. Second ridge 150 is positioned on body 102 such that the second ridge interferes with cocking/firing sleeve 116, thereby defining a farthest forward extent of sliding travel of cocking/firing sleeve 116 along the axis of body 102.

Vortex ring gun 100 includes nozzle 110 coupled with body 102 of the gun. In at least some embodiments, nozzle 110 is generally cylinder-shaped. In at least some embodiments, nozzle 110 includes a stepped cylindrical shape. In at least some embodiments, nozzle 110 is a stepped right cylindrical shape; however, other shapes are within the scope of the present embodiments, e.g., the nozzle in some embodiments is of a curvilinear nature. Nozzle 110 at least partially surrounds protrusion 128 of body 102 and includes nozzle opening 112 located distal from body 102. Nozzle 110 defines a nozzle bore 114 longitudinally aligned with a center axis of protrusion 128 of body 102 and extending through the nozzle from a side adjacent the body to nozzle opening 112. In at least some embodiments, nozzle 110 includes a flange 142 extending from an outer surface of the nozzle.

Gun 100 also comprises cocking/firing sleeve 116 that at least partially surrounds both body 102 and nozzle 110. Cocking/firing sleeve 116 includes forty-six pressure-venting slots 118 circumferentially spaced around the exterior of the cocking/firing sleeve. In at least some embodiments, cocking/firing sleeve 116 includes greater or fewer than forty-six pressure venting slots 118. In at least some embodiments, pressure-venting slots 118 are generally slit-shaped and include a rounded end. Cocking/firing sleeve 116 defines fluid passageways extending from an interior surface of cocking/firing sleeve 116 to the exterior of the cocking/firing sleeve and terminating at pressure venting slots 118. In at least some embodiments, the defined fluid passageways extend radially away from a centerline of cocking/firing sleeve 116. Cocking/firing sleeve 116 also includes a keyhole 126 into which at least a portion of a latching key 120 protrudes. In at least some embodiments, keyhole 126 has a rectangular shape; however other shapes are within the scope of the present embodiments.

Vortex ring gun 100 also includes latching key 120 that is generally rectangular in shape; however other shapes are within the scope of the present embodiments. During operation of vortex ring gun 100, latching key 120 is constrained by cocking/firing sleeve 116 to slide along keyway 122 when cocking/firing sleeve 116 is slid along the axis of body 102. In at least one position (the cocked position) along keyway 122, latching key 120 serves to constrain the positions of nozzle 110 and cocking/firing sleeve 116 relative to each other (latched). In at least one other position (firing position) along keyway 122, latching key 120 allows nozzle 110 and cocking/firing sleeve 116 to move freely relative to each other (unlatched).

Vortex gun 100 also includes an energy storage element 148 that is positioned between cocking/firing sleeve 116 and nozzle 110, coaxial with nozzle 110, and adjacent to flange 142 of the nozzle. In at least some embodiments, energy storage element 148 is a spring. In at least some embodiments, gun 100 includes a different energy storage element, e.g., an elastic material, a pressurized gas, or another suitable energy storage element. Energy storage element 148 is capable of storing the energy exerted by a user of vortex gun 100 during a manual cocking operation of vortex gun 100. Energy storage element 148 is capable of releasing the stored energy causing the production of a vortex ring during a firing operation of gun 100. Sliding the cocking/firing sleeve 116 back and forth along an axis of vortex ring gun 100 performs the alternate cocking and firing operations. In at least some embodiments, the cocking/firing operations are automated. In at least some other embodiments, the cocking/firing operations are powered by an energy source such as a battery, fuel, a compressed gas, or another suitable energy source.

Figure 4:
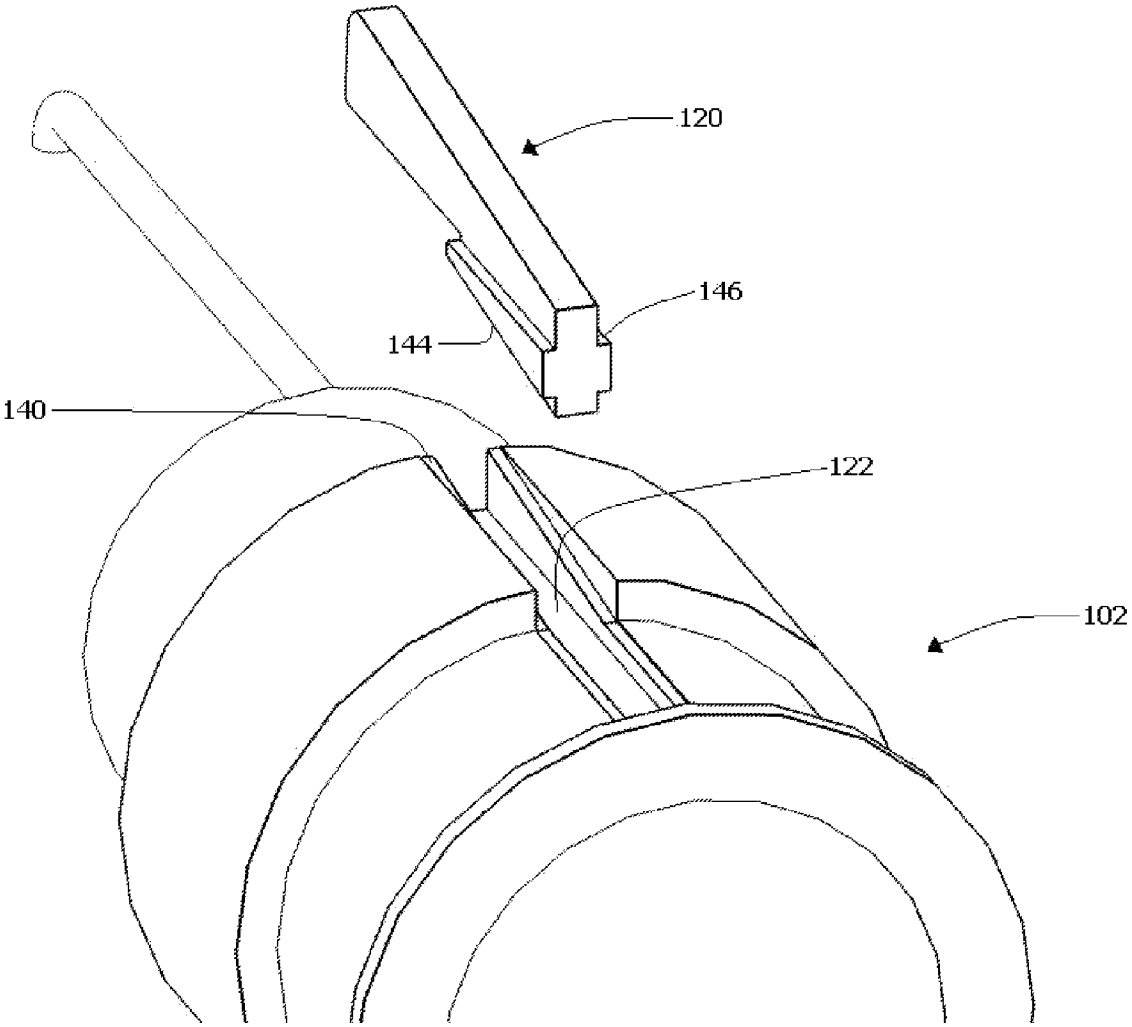
FIG. 4 is an exploded view of the latching key and keyway of the vortex ring-producing gun of FIG. 1.

FIG. 4 is an exploded view of latching key 120 and keyway 122 of vortex ring gun 100. Latching key 120 includes at least one ramped surface 144 that interfaces with at least one ramped surface 140 of keyway 122 of body 102. Latching key 120 also includes at least one protrusion 146 that interfaces with cocking/firing sleeve 116 and serves to retain latching key 120 within cocking/firing sleeve 116 and keyway 122.

Figure 5:
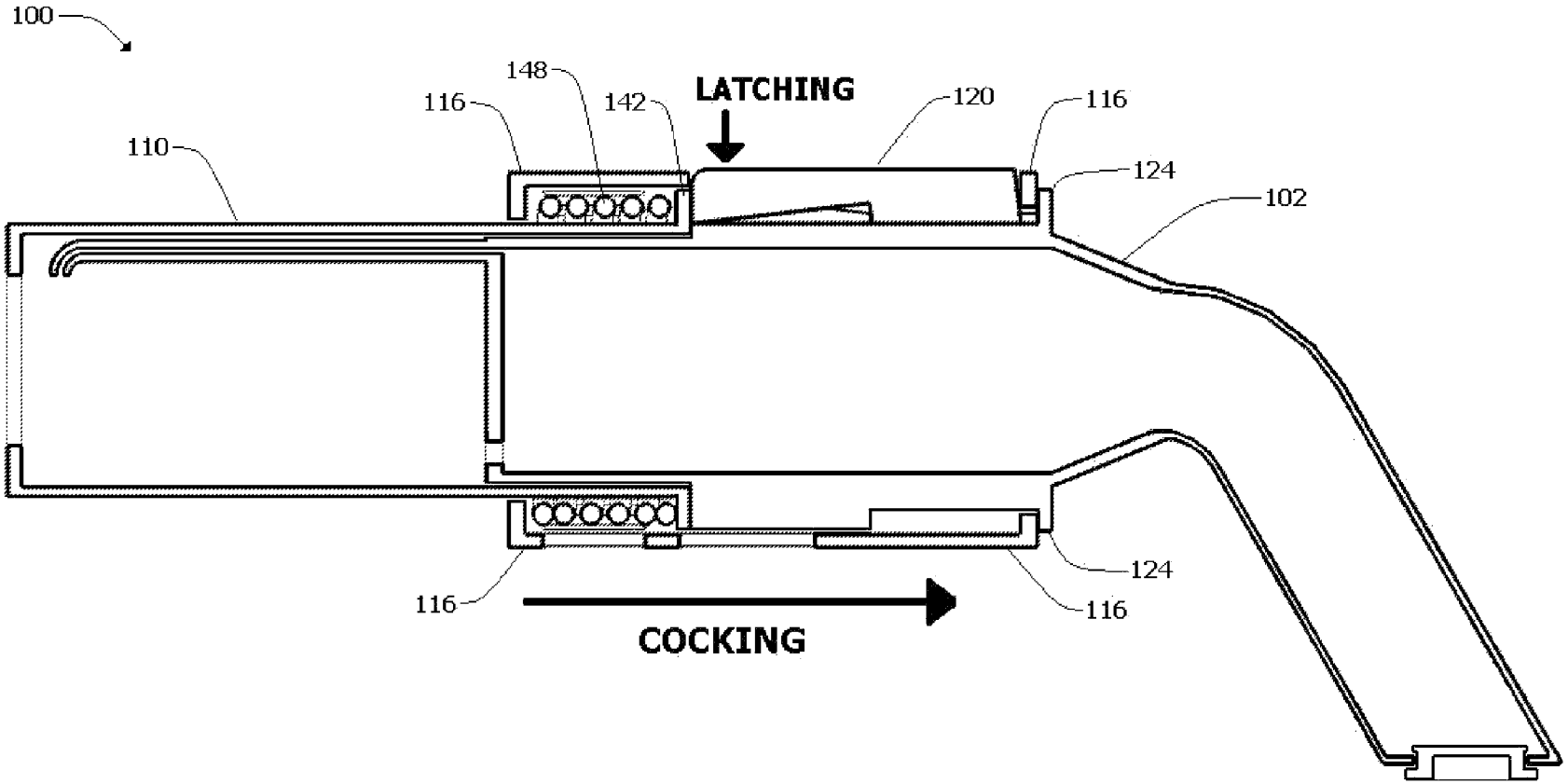
FIG. 5 is a side section view of the vortex ring-producing gun of FIG. 1 in a cocked condition.

FIG. 5 is a side section view of vortex gun 100 in a cocked condition resulting from a cocking stroke. Vortex gun 100 is transitioned to the cocked condition by sliding cocking/firing sleeve 116 rearward on body 102 until sleeve 116 contacts first ridge 124 of body 102. The rearward movement of cocking/firing sleeve 116 causes latching key 120 to slide rearward along keyway 122 until latching key 120 drops into a position between flange 142 of nozzle 110 and cocking/firing sleeve 116. When latching key 120 is in a position between flange 142 of nozzle 110 and cocking/firing sleeve 116 the two components are latched together such that they do not slide relative to each other. The rearward movement of cocking/firing sleeve 116 during cocking also causes energy storage element 148 to become compressed between nozzle 110 and cocking/firing sleeve 116, thereby storing energy exerted during cocking.

Figure 6:
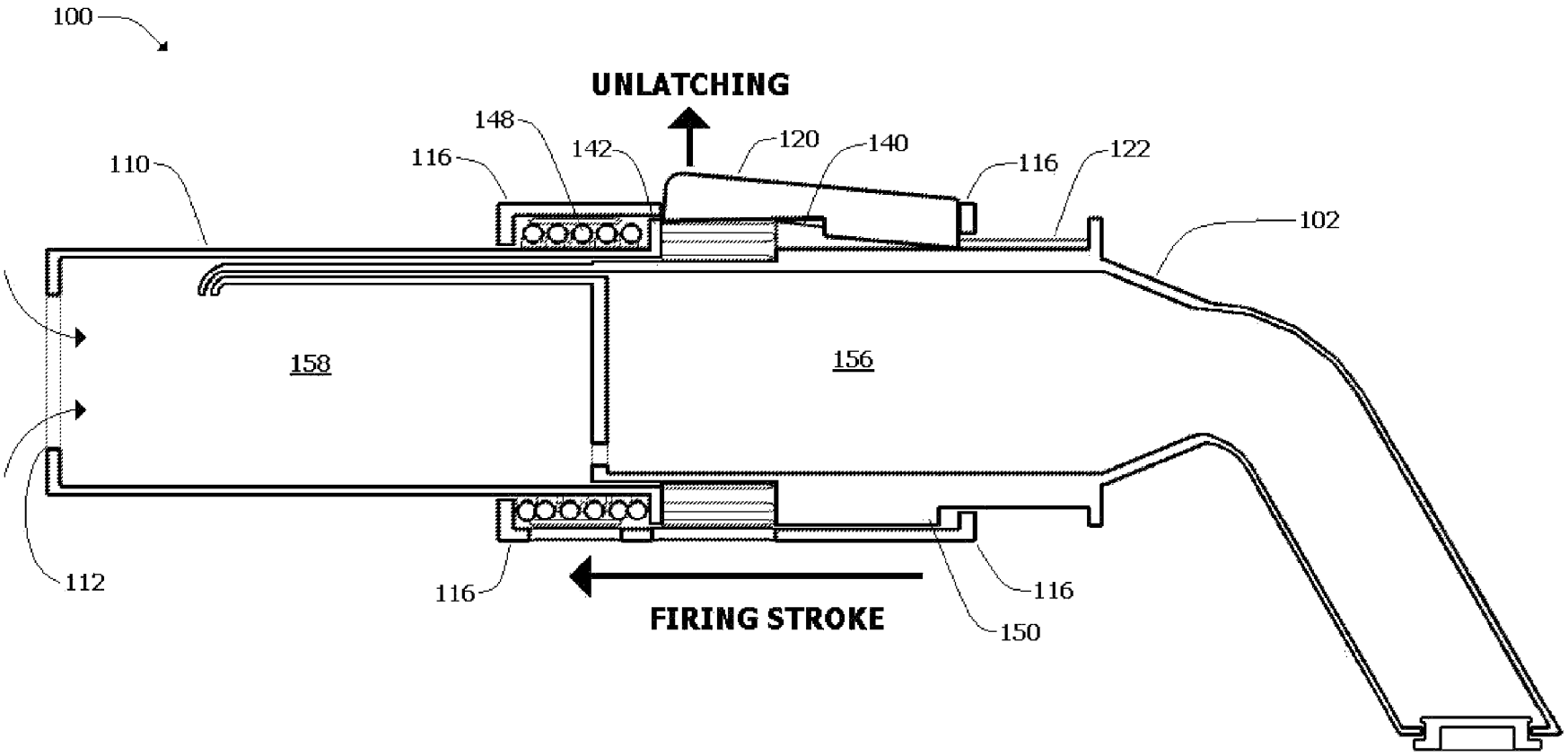
FIG. 6 is a side section view of the vortex ring-producing gun of FIG. 1 in a pre-fire condition.

FIG. 6 is a side section view of vortex gun 100 in a pre-fire condition. The depicted pre-fire condition occurs prior to the end of a firing stroke. A firing stroke includes moving cocking/firing sleeve 116 forward on body 102 from the cocked position until cocking/firing sleeve 116 contacts second ridge 150. During the firing stroke, cocking/firing sleeve 116, latching key 120, nozzle 110, and energy storage element 148 all move forward together on body 102. The firing stroke causes a volume of second chamber 158 to increase, and thereby draw fluid from outside the gun 100, through nozzle opening 112, into expanding second chamber 158. The firing stroke also causes latching key 120 to slide up ramp 140 of keyway 122. The movement of latching key 120 up ramp 140 of keyway 122 causes latching key 120 to slide up the surface of flange 142 of nozzle 110 toward an unlatched condition.

Figure 7:
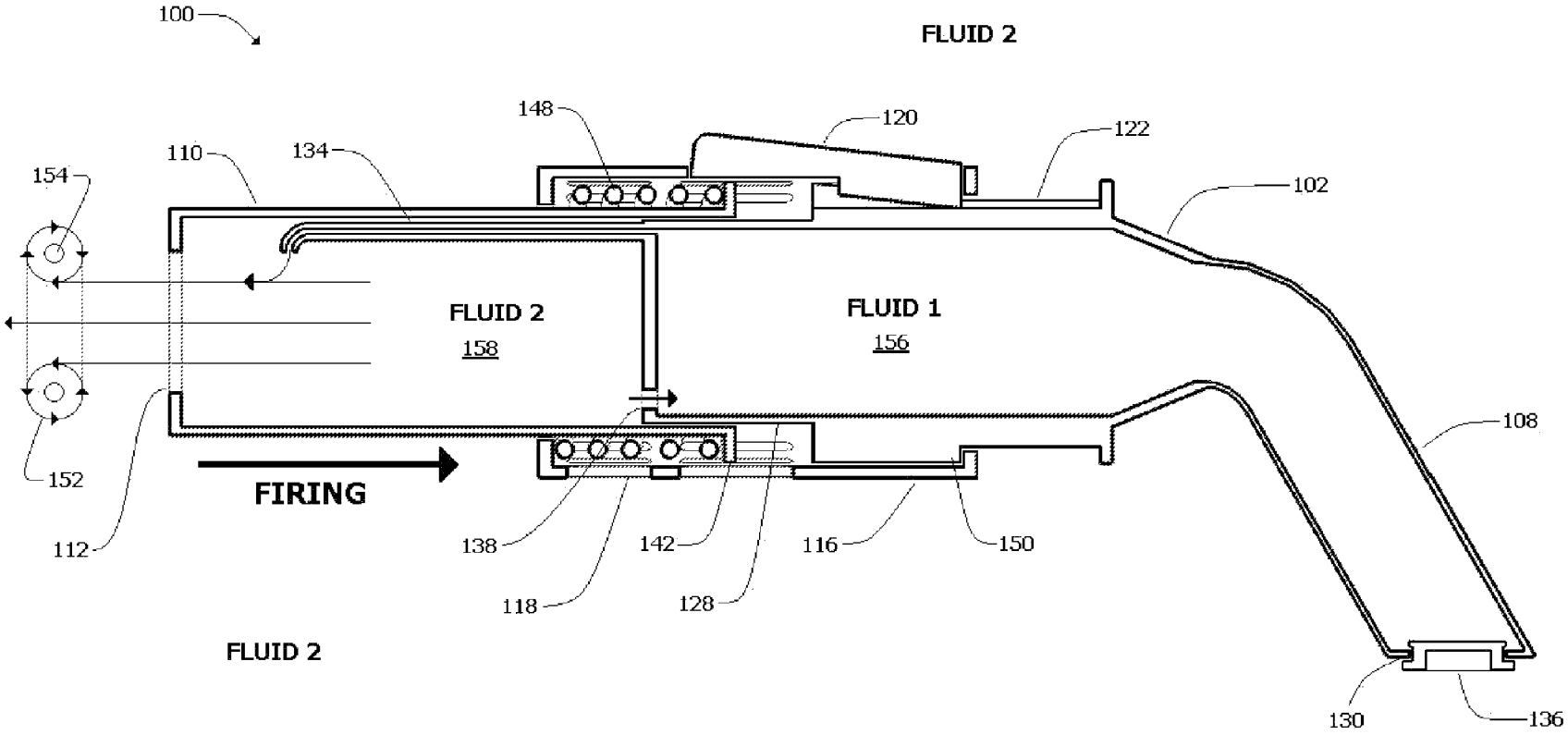
FIG. 7 is a side section view of the vortex ring-producing gun of FIG. 1 in a firing condition.

FIG. 7 is a side section view of vortex gun 100 in a firing condition. In this depiction, first chamber 156 of vortex gun 100 contains Fluid 1, vortex gun 100 is surrounded by Fluid 2, and second chamber 158 inside nozzle 110 is filled with Fluid 2. Vortex gun 100 commences firing at the end of a firing stroke, i.e., when cocking/firing sleeve 116 is moved forward on body 102 such that sleeve 116 contacts second ridge 150, said forward motion causing latching key 120 to move up ramp 140 of keyway 122 to an unlatched position where latching key 120 is clear of flange 142 of nozzle 110. Since flange 142 is clear of latching key 120, compressed energy storage element 148 accelerates nozzle 110 rearward on protrusion 128 of body 102. The acceleration of nozzle 110 rearward compresses Fluid 2 inside nozzle 110 and forces Fluid 2 out through nozzle opening 112. Fluid 2 exits through nozzle opening 112 and forms a circulating vortex ring 152 outside nozzle opening 112 of nozzle 110. Vortex ring 152 includes a core 154 comprised of Fluid 1 that is entrained into Fluid 2 as Fluid 2 moves rapidly past the opening of fluid conduit 134. Vortex ring 152 will exist in stable equilibrium with core 154 when Fluid 1 has a density that is less than the density of Fluid 2. Also during firing, a portion of compressed Fluid 2 moves through conduit 138 into first chamber 156 to replace the portion of Fluid 1 that exited first chamber 156 through fluid conduit 134. Firing is completed when vortex gun 100 has returned to the relaxed condition depicted in FIG. 3, i.e., energy storage element 148 is fully expanded, and nozzle 110 is positioned as rearward as possible on protrusion 128 of body 102.

One of ordinary skill in the art would recognize that the diameters and lengths of fluid conduits 134 and 138 are adjustable to control flows of Fluid 1 out of first chamber 156, and Fluid 2 into first chamber 156. In at least some embodiments, said flows are restricted such that Fluid 1 is only drawn out through conduit 134 when recoiling nozzle 110 causes Fluid 2 to flow rapidly past the opening of fluid conduit 134 during firing. In at least some embodiments, said flow is unrestricted to the extent that Fluid 1 flows out through fluid conduit 134 at a predetermined rate when the parts of the gun are at rest. In at least some other embodiments, said flow is unrestricted by removing plug or cover 136. In at least some embodiments, fluid conduit 138 is not present.

In at least some embodiments, one or more additional fluid supply tanks are positioned on or near gun 100 and connected via one or more supply lines to body 102 or nozzle 110 of gun 100. In at least some embodiments, different sizes, shapes, volumes, and/or positions of the fluid supply tank are contemplated. In at least some embodiments, the one or more additional fluid supply tanks include an opening through which a fluid, e.g., air, another gas, a colorant, a colored fluid, etc., is added.

In at least some embodiments, vortex gun 100 includes a supply line extending an open end above a water surface and connected at another end to body 102 or nozzle 110 of gun 100. In at least some embodiments, the supply line is made of a rigid, flexible, or semi-rigid material. In at least some embodiments, the supply line also includes a one-way valve to allow entry of air from above the water level into body 102 or nozzle 110 of gun 100, and prevent exit of the same. In at least some other embodiments, the one-way valve is positioned and/or attached or formed as part of body 102 or nozzle 110 of gun 100. In at least some embodiments, plug or cover 136 includes an opening for receiving the supply line.

Disclosed herein is a novel design for toy vortex gun 100 that is usable underwater in a swimming pool or bathtub. Body 102 of toy gun 100 acts as a chamber to hold a volume of air, colored fluid, or one or more colored soluble pellets. The gun 100 is able to be cocked above or below the water surface. When gun 100 is first submerged, nozzle 110 is pointed upward to release air bubbles, and thereby fill the nozzle with water. Vortex gun 100 is cocked by holding body 102 fixed with one hand while pulling cocking/firing sleeve 116 rearward to a farthest extent with the other hand. The cocking action compresses the energy storage element 148 and latches nozzle 110 to cocking/firing sleeve 116 by action of latching key 120. The vortex gun 100 is fired by holding body 102 fixed with one hand while pulling the cocking/firing sleeve 116 forward to a farthest extent with the other hand. At the end of the forward firing stroke latching key 120 unlatches nozzle 110 from the cocking/firing sleeve 116, and the nozzle is rapidly accelerated rearward by the expansion of the compressed energy storage element 148. Water inside recoiling nozzle 110 is compressed and thereby forced out nozzle opening 112 causing the emission of rotating vortex ring 152 that travels underwater. If body 102 of the toy gun 100 is loaded with air, the emitted vortex ring 152 will be composed of spinning water with core 154 of air. This air filled vortex ring will be visible underwater due to the difference in index of refraction of water and air. If body 102 of the gun 100 is filled with water, then the vortex ring 152 emitted from the toy gun is composed only of water, and is invisible as the vortex ring travels underwater. If one or more colored soluble pellets are placed inside body 102 of the gun 100 with water, or, if colored fluid is placed inside the body of the gun, then colored vortex rings 152 will be emitted from the gun. In all of the aforementioned configurations, vortex ring 152 carries energy away from gun 100 in the forms of angular momentum and translational momentum.

Vortex ring gun 100 disclosed herein can be repetitively cycled indefinitely between the cocking and firing states by sliding cocking/firing sleeve 116 back and forth between farthest extents on body 102 of the gun. The cycling between cocking and firing states is manual, or automated using a mechanism with an energy source such as a battery or compressed gas. The vortex gun cycling between cocking and firing states will produce a continuous series of vortex rings 152 having cores 154 composed of fluid drawn from inside the body of gun 100 until that fluid is depleted.

Toy vortex gun 100 disclosed herein utilizes recoiling nozzle 110 to provide pressure relief during a point blank firing situation. For example, if a child were to fire gun 100 disclosed herein with nozzle 110 against his ear, or another child's ear, the nozzle recoils a distance away from the child's head such that the fluid ejected from the nozzle may escape through the space between the recoiled nozzle and the child's head; thereby producing a lesser amount of pressure than if the nozzle had stayed effectively sealed against the child's head. Also, since vortex gun 100 disclosed herein utilizes recoiling nozzle 110 instead of a forward moving piston, loose fitting foreign objects such as sticks inserted into the nozzle will not be ejected from the gun when fired.

Figure 8:
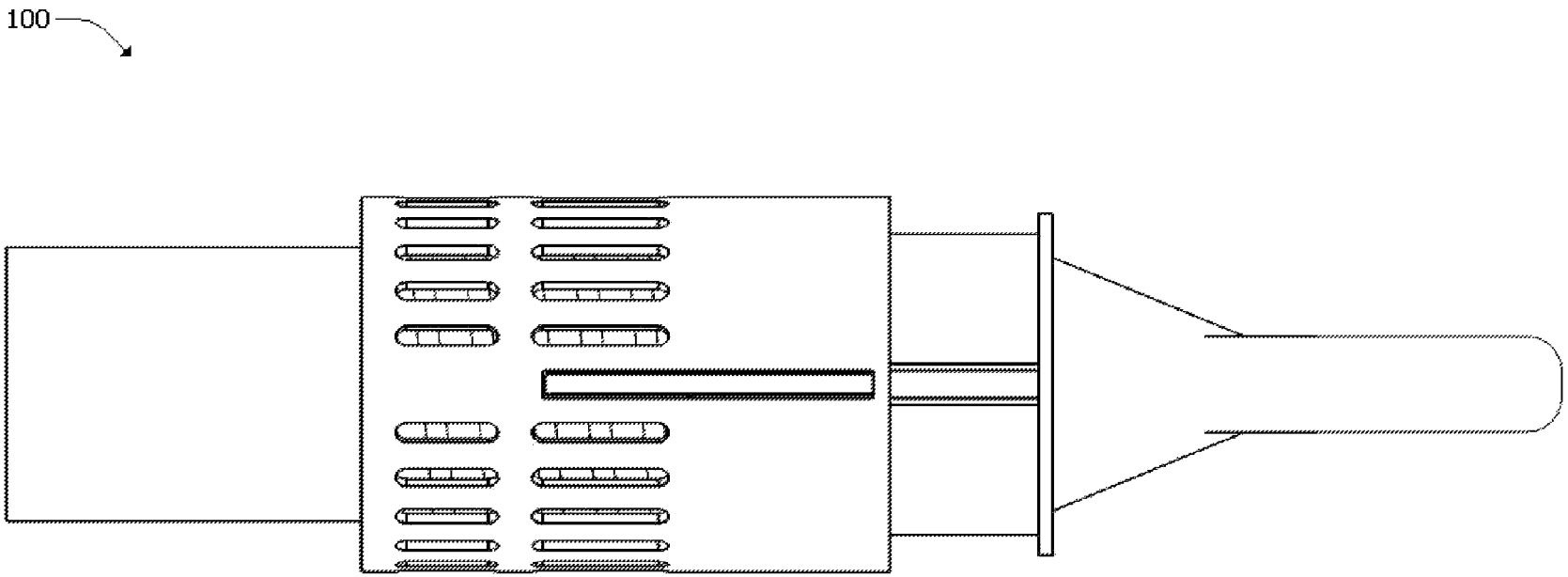
FIG. 8 is a top plan view of the vortex ring-producing gun of FIG. 1.

FIG. 8 is a top plan view of vortex gun 100.

Figure 9:
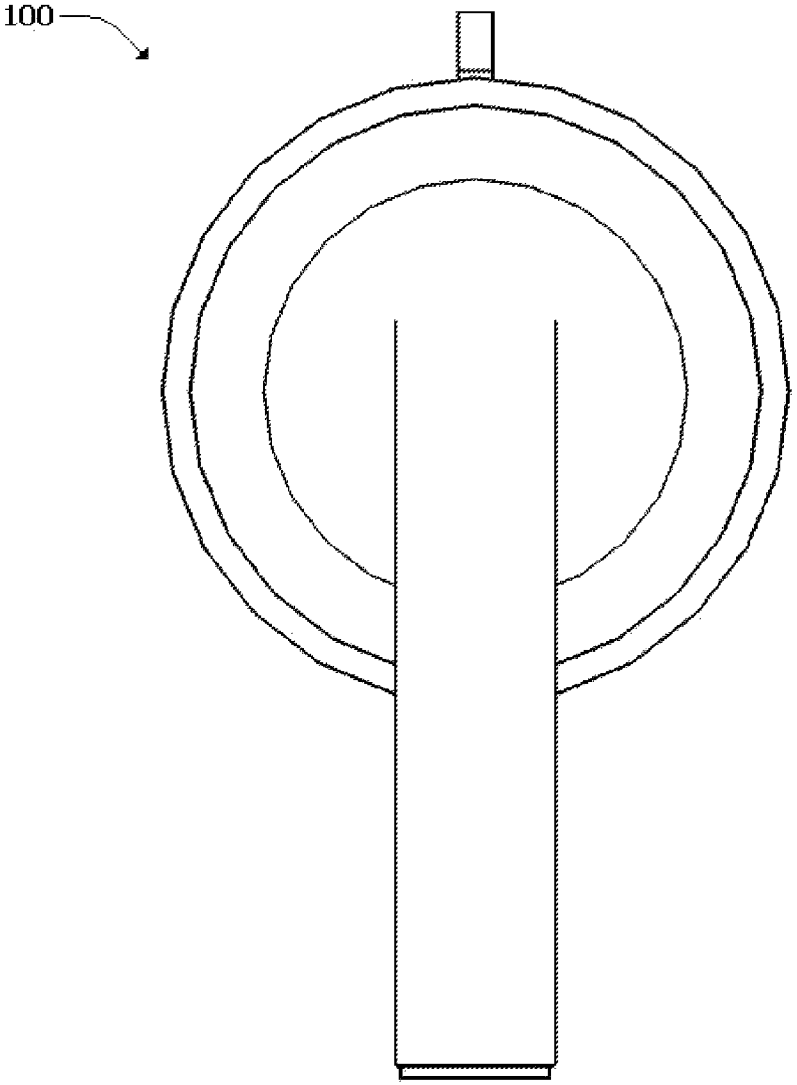
FIG. 9 is a rear plan view of the vortex ring-producing gun of FIG. 1.

FIG. 9 is a rear plan view of vortex gun 100.

Figure 10:
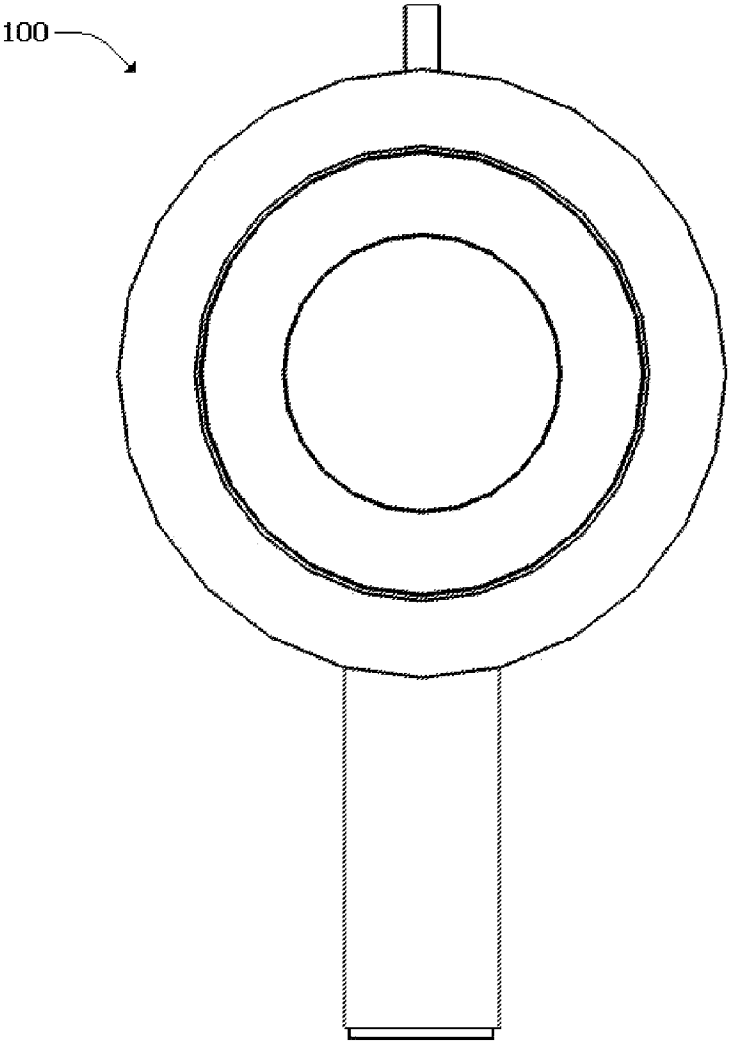
FIG. 10 is a front plan view of the vortex ring-producing gun of FIG. 1.

FIG. 10 is a front plan view of vortex gun 100.

Figure 11:
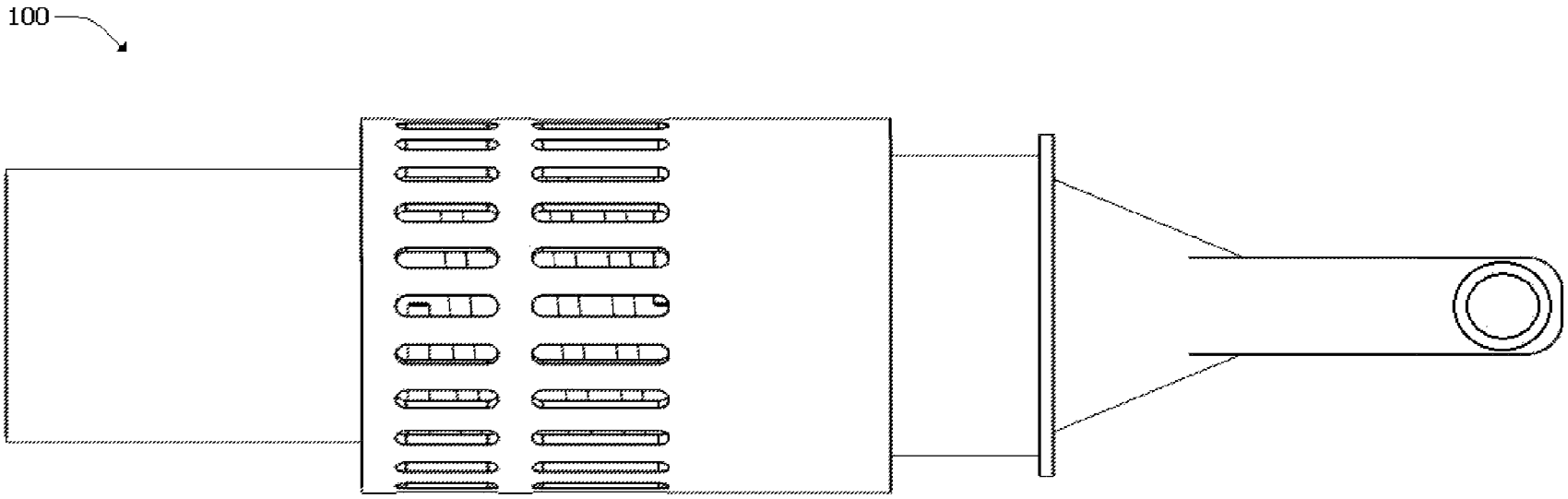
FIG. 11 is a bottom plan view of the vortex ring-producing gun of FIG. 1.

FIG. 11 is a bottom plan view of vortex gun 100.

One aspect of this description relates to a vortex ring producing gun. The vortex ring producing gun includes a body defining a first interior volume. The vortex ring producing gun includes a movable nozzle coupled with the body, comprising at least one nozzle opening, and defining a second interior volume. The vortex ring producing gun includes one or more conduits providing fluid communication between said first interior volume and said second interior volume. The vortex ring producing gun includes an energy storage element configured to bias the movable nozzle in a first direction. The vortex ring producing gun includes a latching key configured to hold the movable nozzle in a retained position against the bias from the energy storage element. The vortex ring producing gun includes a movable cocking/firing element configured to interact with the body, the energy storage element, the latching key, and the movable nozzle to selectively cock or fire the vortex ring-producing gun.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A vortex ring producing gun comprising:

a body defining a first interior volume;

a movable nozzle coupled with the body, comprising at least one nozzle opening, and defining a second interior volume;

one or more conduits providing fluid communication between said first interior volume and said second interior volume;

a movable cocking/firing sleeve at least partially surrounding the body and the moveable nozzle;

an energy storage element between a portion of the moveable nozzle and a first portion of the movable cocking/firing sleeve, wherein the energy storage element is configured to bias the movable nozzle toward the body; and a latching key configured to hold the movable nozzle in a retained position against the bias from the energy storage element, wherein the movable cocking/firing sleeve is configured to interact with the body, the energy storage element, the latching key, and the movable nozzle to selectively cock or fire the vortex ring-producing gun, and the vortex ring producing gun is configured to reduce a length of an external dimension of the vortex ring producing gun along an axis parallel to a central, longitudinal axis of a nozzle bore of the movable nozzle in response to firing the vortex ring producing gun, and wherein the bias of the energy storage element is configured to accelerate the moveable nozzle toward the body when the latching key transitions from a latched condition to an unlatched condition, said acceleration of the moveable nozzle is configured to cause compression of the contents of the second interior volume for causing expulsion of at least a portion of said contents through the at least one nozzle opening, and for forming a vortex ring.

2. The vortex ring producing gun of claim 1, wherein at least a portion of the body is a handgrip.

3. The vortex ring producing gun of claim 1, further comprising an opening in the body that provides fluid communication between the first interior volume and an exterior of the body.

4. The vortex ring producing gun of claim 3, wherein the opening in the body is positioned near a lowest extent of the body.

5. The vortex ring producing gun of claim 3, wherein the opening is configured to receive a plug positioned for preventing fluid communication between the first interior volume and the exterior of the body.

6. The vortex ring producing gun of claim 3, further comprising a cover positioned over said opening such that fluid communication between the first interior volume and the exterior of the body is prevented.

7. The vortex ring producing gun of claim 1, wherein the movable nozzle is positioned at least partially on a protrusion of the body.

8. The vortex ring producing gun of claim 1, wherein the movable nozzle is positioned at least partially in a cavity of the body.

9. The vortex ring producing gun of claim 1, wherein the at least one nozzle opening of the movable nozzle is distal from the body, and provides fluid communication between the second interior volume and an exterior of the moveable nozzle.

10. The vortex ring producing gun of claim 1, wherein a first conduit of the one or more conduits has a tubular structure.

11. The vortex ring producing gun of claim 10, wherein the first conduit extends into the first interior volume.

12. The vortex ring producing gun of claim 11, wherein one end of the first conduit extends to a lowest extent of the first interior volume.

13. The vortex ring producing gun of claim 10, wherein the first conduit extends into the second interior volume.

14. The vortex ring producing gun of claim 13, wherein one end of the first conduit extends to a highest extent of the second interior volume.

15. The vortex ring producing gun of claim 1, wherein a conduit of the one or more conduits is a hole in the body.

16. The vortex ring producing gun of claim 1, wherein a conduit of the one or more conduits is positioned at an upper extent of the body.

17. The vortex ring producing gun of claim 1, wherein a conduit of the one or more conduits is positioned at a lower extent of the body.

18. The vortex ring producing gun of claim 1, wherein the body comprises a keyway, wherein a long dimension of the keyway is parallel to an axis of motion of the cocking/firing sleeve.

19. The vortex ring producing gun of claim 18, wherein the keyway has a lengthwise-sloped surface that is non-parallel to the axis of motion of the moveable cocking/firing sleeve.

20. The vortex ring producing gun of claim 19, wherein the latching key has a sloped surface that interfaces with the lengthwise-sloped surface of the keyway.

21. The vortex ring producing gun of claim 20, wherein the latching key is configured to move down the slope of the keyway during a cocking stroke and up the slope of the keyway during a firing stroke.

22. The vortex ring producing gun of claim 1, wherein the body comprises a protrusion configured to limit a maximum extent of rearward travel of the moveable cocking/firing sleeve.

23. The vortex ring producing gun of claim 1, wherein the body comprises a protrusion configured to limit a maximum extent of forward travel of the moveable cocking/firing sleeve.

24. The vortex ring producing gun of claim 1, wherein the moveable cocking/firing sleeve comprises a keyhole into which at least a portion of the latching key extends, the interaction of said keyhole and portion of the latching key is configured to cause the moveable cocking/firing sleeve to be able to control the position of the latching key along a pathway parallel to an axis of motion of the cocking/firing sleeve.

25. The vortex ring producing gun of claim 1, wherein the latching key comprises one or more protrusions configured to interfere with one or more surfaces of the cocking/firing sleeve such that the latching key is retainable within the cocking/firing sleeve.

26. The vortex ring producing gun of claim 1, wherein the moveable cocking/firing sleeve comprises at least one pressure-venting channel that provides fluid communication between an interior and an exterior of the moveable cocking/firing sleeve.

27. The vortex ring producing gun of claim 1, wherein the moveable cocking/firing sleeve is configured to transfer cocking energy to the energy storage element during a cocking stroke.

28. The vortex ring producing gun of claim 1, wherein the energy storage element is a spring.

29. The vortex ring producing gun of claim 1, wherein the portion of the moveable nozzle is a flange.

30. The vortex ring producing gun of claim 1, wherein the first portion of the moveable cocking/firing sleeve is a flange.

31. The vortex ring producing gun of claim 1, wherein the moveable cocking/firing sleeve is configured to move the latching key to a latched condition during a cocking stroke, and an unlatched condition at the end of a firing stroke.

32. The vortex ring producing gun of claim 1, wherein, in a cocked and latched condition, the latching key is positionable between the portion of the moveable nozzle and a second portion of the moveable cocking/firing sleeve, and the energy storage element is configured to provide a bias force against the portion of the moveable nozzle toward the second portion of the moveable cocking/firing sleeve for trapping the latching key between the portion of the movable nozzle and the second portion of the moveable cocking/firing sleeve.

33. The vortex ring producing gun of claim 32, wherein the portion of the moveable nozzle is a flange.

34. The vortex ring producing gun of claim 32, wherein the second portion of the moveable cocking/firing sleeve is a flange.

35. The vortex ring producing gun of claim 1, wherein the moveable cocking/firing sleeve is configured to move the moveable nozzle away from the body during a firing stroke for causing the second interior volume to increase, and for drawing fluid into the second interior volume through the at least one nozzle opening.

* * * * *